US007108344B2

(12) United States Patent
Yraceburu et al.

(10) Patent No.: US 7,108,344 B2
(45) Date of Patent: Sep. 19, 2006

(54) PRINTMODE FOR NARROW MARGIN PRINTING

(75) Inventors: Robert M. Yraceburu, Camas, WA (US); Mark S. Hickman, Vancouver, WA (US); Steve O. Rasmussen, Vancouver, WA (US)

(73) Assignee: Hewlett-Packard Devleopment Company, L.P., Houston, TX (US)

( * ) Notice: Subject to any disclaimer, the term of this patent is extended or adjusted under 35 U.S.C. 154(b) by 250 days.

(21) Appl. No.: 10/701,231

(22) Filed: Nov. 3, 2003

(65) Prior Publication Data

US 2005/0093901 A1 May 5, 2005

(51) Int. Cl.
*B41J 29/38* (2006.01)

(52) U.S. Cl. ..... 347/9; 347/104; 347/101; 347/16; 347/37

(58) Field of Classification Search ..... None
See application file for complete search history.

(56) References Cited

U.S. PATENT DOCUMENTS

| | | | | |
|---|---|---|---|---|
| 5,997,129 | A | 12/1999 | Matsuhashi | |
| 6,139,140 | A | 10/2000 | Rasmussen et al. | |
| 6,239,817 | B1 | 5/2001 | Meyer | |
| 6,375,307 | B1 | 4/2002 | Vinals et al. | |
| 6,454,389 | B1 | 9/2002 | Couwenhoven et al. | |
| 6,464,316 | B1 | 10/2002 | Askeland et al. | |
| 6,536,869 | B1 * | 3/2003 | Bland et al. | 347/41 |
| 6,540,315 | B1 | 4/2003 | Nystrom et al. | |
| 6,869,176 | B1 * | 3/2005 | Saito | 347/104 |
| 6,896,349 | B1 * | 5/2005 | Valero et al. | 347/22 |

* cited by examiner

*Primary Examiner*—Thinh Nguyen
*Assistant Examiner*—Brian J. Goldberg

(57) ABSTRACT

A printmode for an inkjet printer including a plurality of print nozzles and an edge guide projecting into a printzone into which at least one of the plurality of print nozzles may be transported for deposition of a fluid onto a print media, the printmode including a printmask defining a print disable zone corresponding to a pre-selected area of the printzone that includes an area of the edge guide that projects into the printzone.

14 Claims, 6 Drawing Sheets

PRINTMODE FOR NARROW MARGIN PRINTING

FIELD OF THE INVENTION

This invention relates to inkjet printers, and more particularly to printmodes for inkjet printers.

BACKGROUND OF THE INVENTION

The general operation of thermal inkjet imaging devices is well known and one description of such operation may be found for instance in U.S. Pat. Nos. 6,464,316 and 6,536,869, which are incorporated in their entirety by reference herein. An inkjet printer forms a printed image by printing a pattern of individual dots at particular locations of an array defined for the printing medium. The locations may be visualized as dots in a rectilinear array or pixels. Thus, a printing operation may be viewed as filling a pattern of pixels with dots of ink.

Inkjet imaging devices print dots by ejecting small drops of ink onto a print medium. Typically a movable carriage supports one or more printheads each including ink ejecting nozzles. The carriage traverses over the surface of the print medium, and the nozzles are controlled to eject drops of ink at selected times controlled by a microcomputer or other controller. The timing of the application of the ink drops is intended to correspond to the pattern of pixels of an image being printed.

A typical inkjet includes an array of nozzles attached to a printhead that includes an array of chambers for receiving ink from a reservoir. Each chamber is fluidly connected to a nozzle so ink can collect in the chamber and the nozzle. A firing resistor is associated with each chamber. Ejection of an ink drop is typically controlled by a microprocessor, the signals of which are conveyed by electrical traces to the firing resistors. When electric printing pulses heat the resistor, a portion of the ink vaporizes and a drop of ink is ejected from the nozzle. Nozzles are commonly arranged to form a dot matrix pattern. The controlled firing of each nozzle causes characters or images to be printed upon a media as the printhead moves past the media.

In inkjet printing, data representative of an image is composed of a set of data comprising a two dimensional array based on x and y coordinates of "pixels". Pixel location is specified by its x and y coordinates in the array. The x coordinate of the pixel may be referred to as the row coordinate value, and the y location of the pixel may be referred to as the column coordinate value. The term "image data" is used herein to refer to an array of pixels having digital code values that form an image.

Specific inking patterns used in each pass, and the manner in which the inking patterns cumulatively form an image, is known as a printmode. Manipulation of printmodes allow the printer to control various factors that influence image quality, including the amount of ink placed on the print media at any given pixel, (image density), the speed with which the ink is placed, and the number of passes required to complete the image. A printmask is a binary pattern that defines which ink drops are printed in a given pass, which passes are used to print any given pixel and which nozzle will be used to print any given pixel location. Thus, the printmask defines both the pass and the nozzle which will be used to print each pixel location, i.e., each row number and column number on the media. A printmode typically defines one or more printmasks used in printing an image, the number of passes required to complete any given portion of the image and the number of drops per pixel.

The printhead is scanned repeatedly across the width of the medium to be printed upon. At each of a designated number of increments of movement across the medium, each nozzle may or may not be print enabled or signaled to fire, according to an output of the controlling microprocessor. Each completed movement across the medium can print a pass approximately as high as the number of nozzles arranged in a column of the ink cartridge multiplied times the distance between nozzle centers. After each such completed print pass the medium may be advanced by a media feed mechanism a distance substantially equal to a height of the pass or a fraction thereof. The carriage reverses direction and the ink cartridge begins the controlled deposition of ink drops for a subsequent pass.

Under various environmental conditions and with duplex printing, media sometimes curls causing edges of media to lift off a platen surface where printing occurs. This may be a problem with scanning inkjet printheads because print quality is best when printheads are positioned close to media. If edges lift up, the printheads will catch on them and damage media, printheads and/or the printer as the printheads scan across the media. If the media edges are held down though the entire print-zone length, large print margins will be required.

Previous solutions have included holding the media down for the entire printzone length, observing a narrower printzone. This solution, however, does not allow for small margin or full bleed printing. Another solution has been to hold the media edges down just upstream of the printzone. Another solution has been to angle the media down at the platen where printing occurs and not support the media at the edges so the media continues to angle down away from the printheads as it progresses further into the printzone. Both of these solutions provide acceptable results for shorter printheads and printzones but become increasingly less efficient with the increase in size of printheads and printzones. Vacuum systems may also be employed to hold down media edges but these systems are expensive and vacuum levels may affect ink drop trajectory and linefeed advance accuracy.

It may, therefore, be advantageous to provide media guides in the printzone that engage the edges of the media and guide the media in through at least a portion of the printzone. Nevertheless, placement of edge guides within a printzone, even if such edge guides only obstruct a marginal portion of the print media pose a challenge to structuring print routines that are capable of either printing within or around such obstructions.

Advantage may also be found in providing a print routine operable by an inkjet imaging device that allows for small margin and/or full bleed printing in an area of the printzone that is defined as a print disable zone or that includes an obstruction between the print media and the printhead.

SUMMARY OF THE INVENTION

The present invention is directed to a printmode for an inkjet printer including a plurality of print nozzles and an edge guide projecting into a printzone into which at least one of the plurality of print nozzles may be transported for deposition of a fluid onto a print media, the printmode comprising a printmask defining a print disable zone corresponding to a pre-selected area of the printzone. The print zone may be defined as an area substantially equal to an aggregate length of the plurality of print nozzles times a width of a print media. The print disable zone may be defined as including an area of the printzone substantially equal to an area of the edge guide that projects into the printzone. Alternately, a print disable zone may include an area of the printzone substantially equal to a length of the edge guide times a width of that portion of the print media that lies beneath the edge guide. Alternately, the print disable zone may include an area of the printzone substantially equal to a length of the edge guide times a width of the print media.

The present invention is also directed to an inkjet imaging device including a printer controller, a media transport assembly connected to and controlled by the printer controller for transporting a print media along a media travel direction, a printhead including a plurality of print nozzles, the printhead connected to and controlled by the printer controller, the printhead connected to a carriage for transporting the printhead across the print media. The inkjet imaging device also includes a printzone defined by a height of the plurality of print nozzles and the width of the print media. The inkjet imaging device may also include an edge guide located adjacent to a marginal edge of the print media, the edge guide projecting into the printzone. In order to achieve full bleed or narrow margin printing, the inkjet imaging device also includes a printmode comprising a printmask defining a print disable zone corresponding to a pre-selected area of the printzone.

The present invention is also directed to a method for narrow margin printing with an inkjet printer including the step of selecting a printmode including a printmask defining a print disable zone corresponding to a pre-selected area of the printzone.

The present invention may be used to advantage in an inkjet imaging device which includes one or more obstructions, for instance one or more media edge guide, located at least partially within a printzone. Edge guides may be arranged and located at least partially within a printzone so the printhead just clears an uppermost surface of the edge guide as the printhead passes over. This allows media just inside and downstream of the edge guides to remain at a reasonable pen-to-paper spacing (PPS). The edge guides project into or occupy a portion of the marginal printzone and do not cover the edge of the media for the entire length of the printzone. For most print jobs, side margins are large enough that printing can be done for the entire length of the printzone between the edge guides.

One advantage of applying the method of the present invention is found in the fact that media control or restraint devices which encroach into the printzone and therefore create potential physical obstructions to the imaging process, may be employed resulting in low Pen-to-Paper Spacing PPS with large print passes. The present invention offers the additional advantages in enabling small margin and/or full bleed printing.

DETAILED DESCRIPTION OF THE INVENTION

Figure 1:
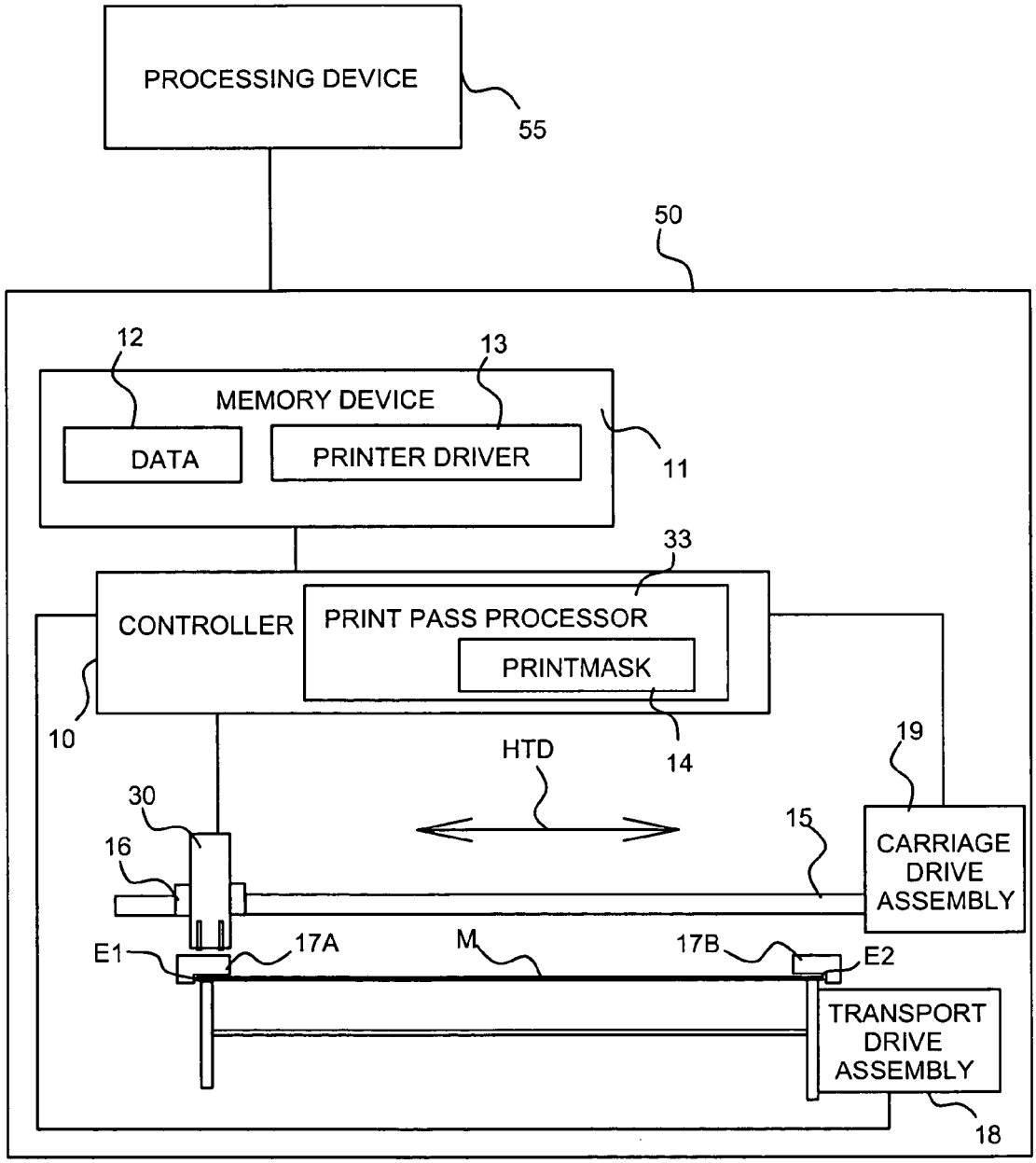
FIG. 1 is a schematic illustration of an imaging system according to one embodiment of the present invention.
Figure 2:
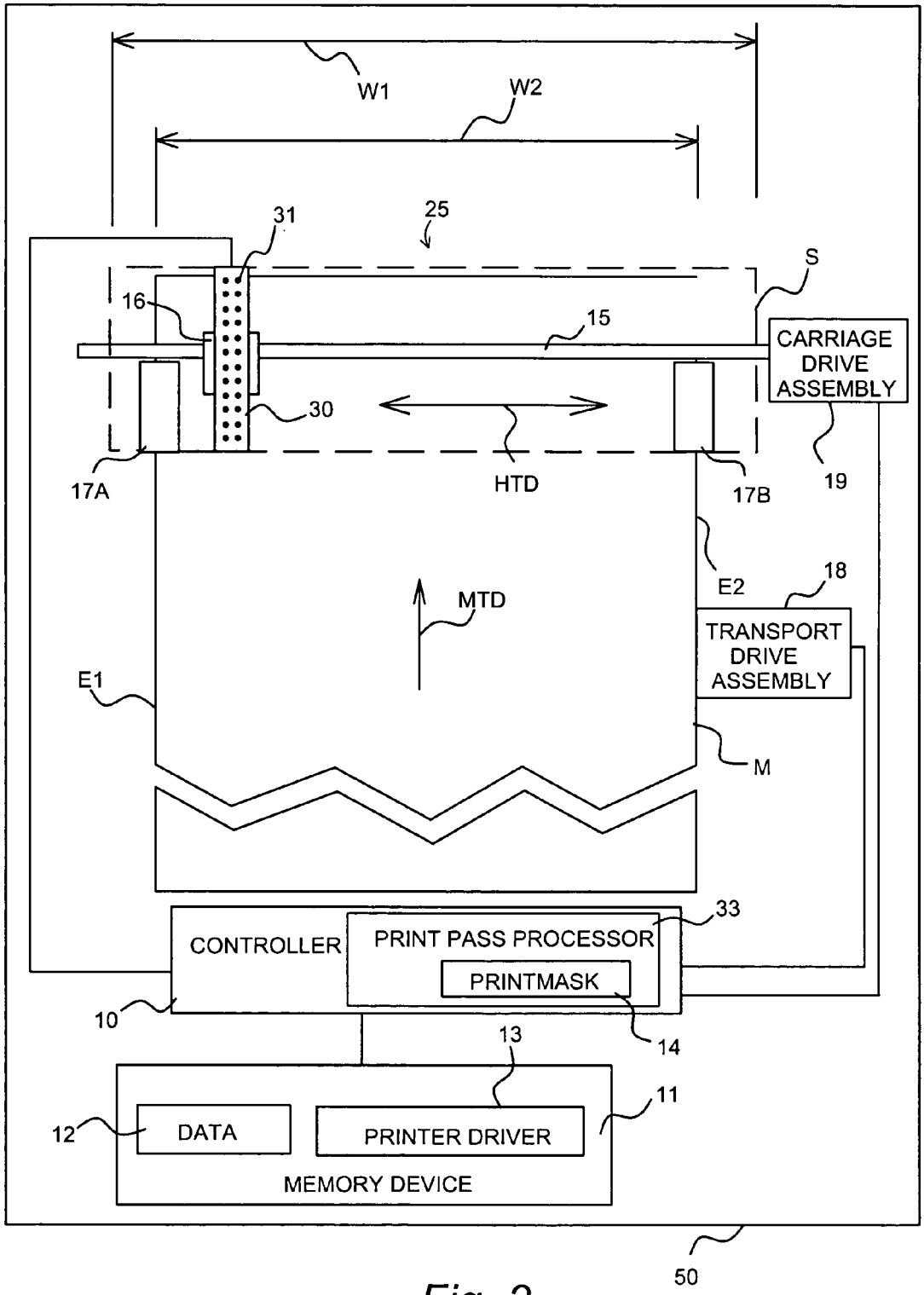
FIG. 2 is a schematic illustration of an imaging system according to one embodiment of the present invention.

Referring to FIG. 1, printer 50 is shown including controller 10 connected to a processing device 55. In FIGS. 1 and 2, printer 50 is shown including controller 10 connected to memory device 11. Memory device 11 may be divided into a plurality of storage areas that facilitate printer operations. Memory device 11 may store digital information as data storage 12 and one or more executable printer drivers 13. Data storage 12 receives the data that define the individual pixel values that are to be printed to form a desired object or textual image on printable media M. Data storage 12 may also contain routines that control carriage drive 19 that causes printhead carriage 16 to be moved along guide rod 15 in head travel directions HTD. Data storage 12 may also contain routines that control transport drive assembly 18, for moving a printable media M through printer 50 from a supply or feed tray, (not shown), through a printzone located beneath printhead 30 to an output location, (not shown).

Edge guides 17A and 17B are positioned at least partially within printzone 25, shown in FIG. 2, and serve to hold marginal edges E1 and E2 in a relatively flat position during a printing operation. To the extent that edge guides 17A and 17B are traversed by printhead 30 during a printing process, they are considered obstructions located within a printzone. During a printing process, controller 10 may receive digital image data from processing device 55, shown in FIG. 1, for example a personal computer or other network appliance, and performs standard image processing routines known in the art.

Controller 10 controls carriage drive assembly 19, media transport drive assembly 18, carriage drive assembly 19 and printhead 30, activating nozzles 31 for ink drop deposition. By combining the relative movement of carriage 16 along head travel directions HTD with the relative movement of print media M along media travel direction MTD, shown in FIG. 2, printhead 30 can deposit one or more drops of ink at each individual one of the pixel locations on print media M.

Printmask 14 is located at print pass processor 33 and is used by print controller 10 to govern the deposition of ink drops from printhead 30. Printmask 14 includes a mask pattern for each pixel position in a row during an individual printing pass, which may both enable the nozzle positioned adjacent the row to print, or disable that nozzle from printing, on that pixel location, and define the number of drops to be deposited from enabled nozzles. Whether or not the pixel will actually be printed on by the corresponding enabled nozzle depends on whether the image data to be printed has defined a pixel in any particular location by a print enable command. Printmask 14 is typically implemented in firmware in printer 50, although it can be alternatively implemented in printer driver 13.

The term "print pass", as used herein, refers to those passes in which printhead 30 is enabled for printing as it moves relative to media M in head travel directions HTD. In a bi-directional print mode, each forward and rearward pass along head travel directions HTD can be a printing pass, while in a unidirectional print mode print passes occur in only one of the head travel directions HTD of movement. As seen in FIG. 2, printhead 30 may move through a print pass S having a width W1. For any given print pass S of printhead 30 over print media M, only certain pixel locations enabled by the printmask may be printed. Printhead 30 deposits the number of drops specified by the printmask for a corresponding pixel location if the image data so requires.

Figure 4:
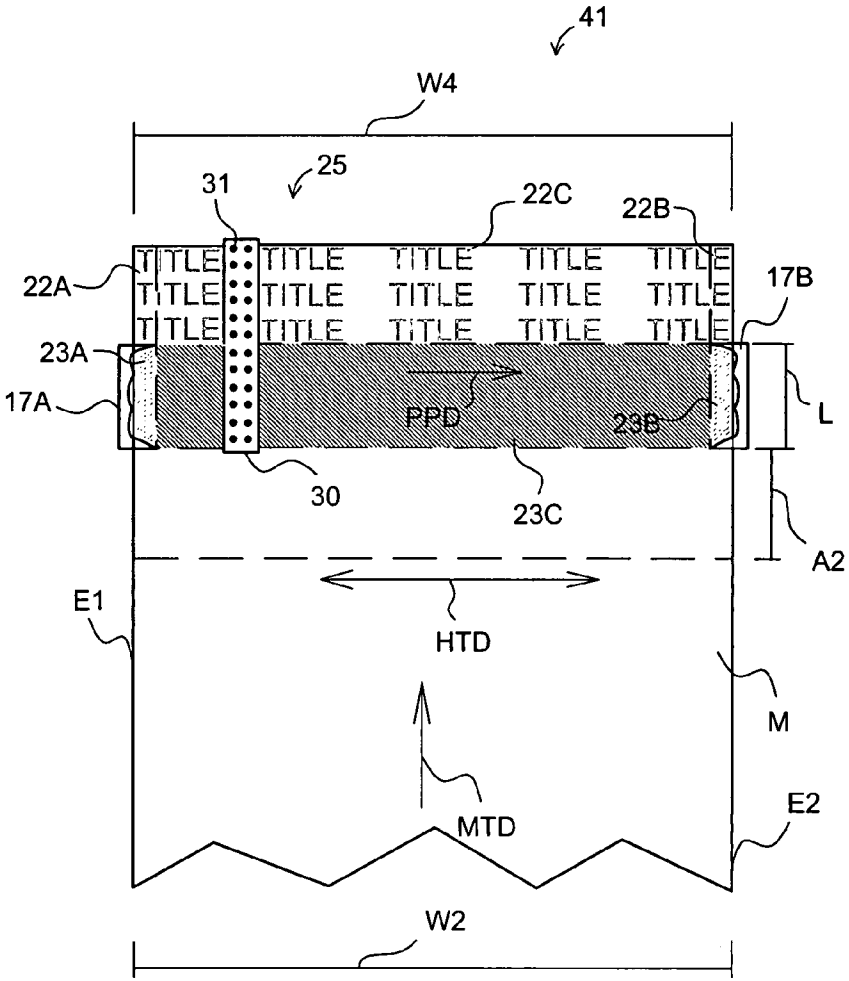
FIG. 4 is a schematic representation of a printzone for an inkjet imaging device.

FIGS. 3 through 7, are schematic representations of a print media M including marginal edges E1 and E2 advancable in media transport direction MTD past print head 30, shown including a plurality of print nozzles designated generally by the numeral 31. Print head 30 is transported in sequential passes over print media M in print pass direction PPD. Following a pass of printhead 30 across print media M through print zone 25, print media M is advanced a distance depending on the print mode. For printmode 40, illustrated in FIG. 3, print media M is advanced a distance A1 per print pass. For printmode 41, as illustrated in FIG. 4, printmode 42, illustrated in FIG. 5 and printmode 43 illustrated in FIG. 6, print media M is advanced a distance A2 per print pass.

Figure 3:
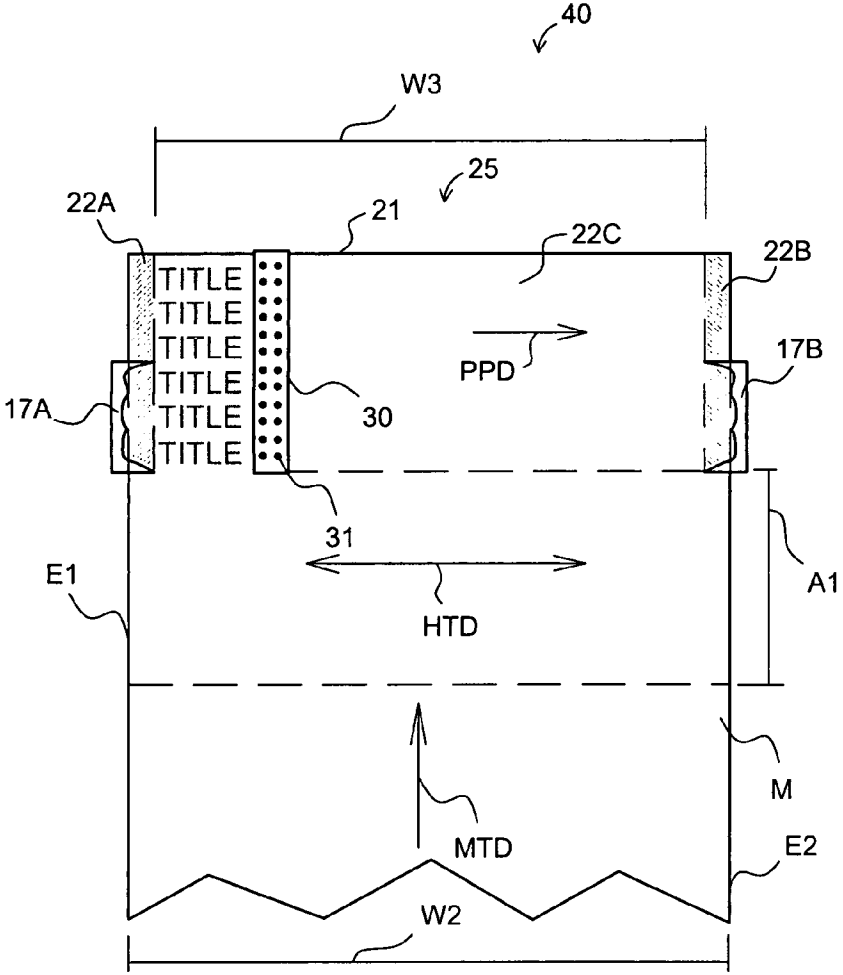
FIG. 3 is a schematic representation of a printzone for an inkjet imaging device.

FIGS. 1 through 6 show edge guides 17A and 17B located adjacent to marginal edges E1 and E2, respectively, of print media M. As seen in FIGS. 3 through 6, edge guides 17A and 17B project into printzone 25. As long as image width W3 is less than a distance between the edge guides, as seen in FIG. 3, all imaging processes may utilize printmode 40 for single pass printing, between edge guides 17A and 17B. In FIGS. 3 through 7, edge guides 17A and 17B are shown partially cut away in order to show marginal zones 23A and 23B respectively. In FIG. 3, print disable zones 22A and 22B are shown located beneath edge guides 17A and 17B respectively and extending down stream of edge guides 17A and 17B. As shown in FIG. 3, for single pass printing between edge guides 17A and 17B, printhead 30 makes a single pass in print pass direction PPD depositing ink in zone 22C of printzone 25. When printhead 30 reaches a limit of travel, print media M is advanced a distance A1 and a subsequent print pass is performed.

Small margin or full-bleed margin printjobs having a width W4, as shown in FIGS. 4 through 7, may be accomplished on an inkjet printer having edge guides 17A and 17B by providing a printmode which permits printing downstream of edge guides 17A and 17B and which includes one or more print disable zones which correspond to no print areas of printzone 25 that are not to be printed in a given pass. Referring to FIG. 4, printmode 41 is employed for single pass print jobs with small or full-bleed margins, or for non-uniform two pass printing. In printmode 41, print disable zones 23A and 23B are shown located beneath edge guides 17A and 17B. In printmode 41, zone 23C is also defined as a print disable zone. In printmode 41, printing occurs only in areas 22A, 22B and 22C of printzone 25. Conversely, no printing occurs within defined print disable zones 23A and 23B, which lie below edge guides 17A and 17B respectively, and print disable zone 23C which lies between print disable zones 23A and 23B. Print disable zones 23A, 23B and 23C include all pixels defined by the printmask that correspond to an area of printzone 25 that is substantially equal a length L of edge guides 17A and 17B times a width W2 of media M. As shown, in FIG. 4, printhead 30 makes a pass in print pass direction PPD depositing ink for a full density image defined by printmode 41 in zones 22A, 22B and 22C of printzone 25 creating full-bleed margins. When printhead 30 reaches a limit of travel, print media M is advanced a distance A2 and a subsequent print pass is performed.

Figure 5:
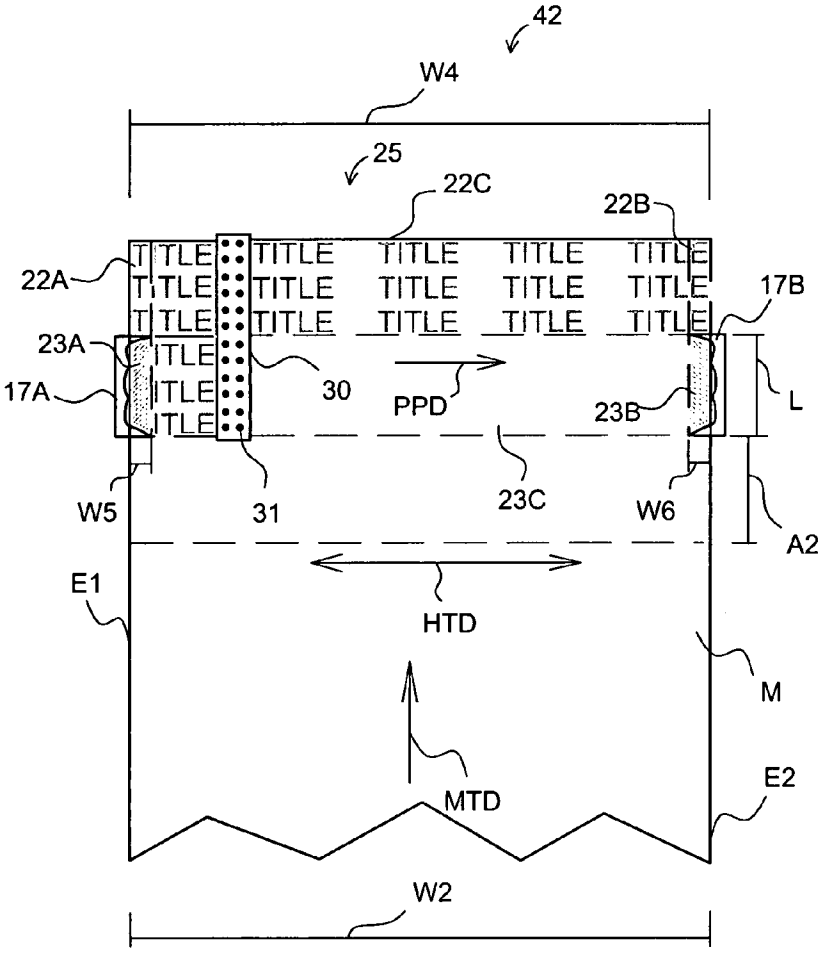
FIG. 5 is a schematic representation of a printzone and a printhead for an inkjet imaging device.

Referring to in FIG. 5, printmode 42, is employed for double or multi-pass printmodes. In printmode 42, printing occurs in areas 23C, 22A, 22B and 22C of printzone 25. Conversely, no printing occurs within defined print disable zones 23A and 23B. Print disable zone 23A includes all pixels defined by the printmask that correspond to an area of printzone 25 that is substantially equal a length L of edge guide 17A times a width W5 of edge guide 17A that overlays print media M. Print disable zone 23B includes all pixels defined by the printmask that correspond to an area of printzone 25 that is substantially equal a length L of edge guide 17B times a width W6 of edge guide 17B that overlays print media M. As shown, in FIG. 5, printhead 30 makes a pass in print pass direction PPD depositing ink for imaging in zones 22A, 22B and 22C creating full-bleed margin zones 22A and 22B. Printhead 30 also deposits ink for imaging in zone 23C while making a pass in print pass direction PPD. When printhead 30 reaches a limit of travel, print media M is advanced a distance A2 and a subsequent print pass is performed. In one embodiment, printhead 30 deposits ink for a full density image in zones 22A and 22B while simultaneously depositing ink for a half density image in zone 23C, and additional ink to achieve a full density image in zone 22C.

Those skilled in the art will recognize that multi-pass printmodes according to the present invention may be employed or are otherwise compatible with the application of variant printmodes. For example, referring to FIG. 5, with two pass even advance printing, each pass can apply 50% ink coverage in zones 22C and 23C. A subsequent pass would do the same for print media M advanced into zones 23C of printzone 25, while adding a remaining 50% of ink or image density media that has advanced from zone 23C to zone 22C. One hundred percent of the ink required for full image density is deposited to zone 22A and 22B.

For three pass printing, a downstream portion of zone 22C, an upstream portion of zone 23C and zone 23C would get 33% ink coverage on first, second, and third passes respectively, assuming that a height of 22C is twice that of 23C. Zones 22A and 22B would get 50% ink coverage in the second and third passes respectively.

The same logic can be used for 4 pass or greater pass printmodes. Add the height of zone 22C and the height of zone 23C and divide the sum by the number of print passes and apply a proportional amount of ink per pass. For example, assuming that zone 22C is 16 mm tall and zone 23C is 32 mm tall, for 8 pass printing the print pass increment would be (16+32)/8=6 mm. Each pass in zone 22C and 23C would get 12.5% ink coverage print pass. Two full increments occur in and 22A and 22B (16 mm)/(6 mm/increment)=2.7 increments and therefore each of these increments would receive 50% of ink coverage per print pass.

Figure 6:
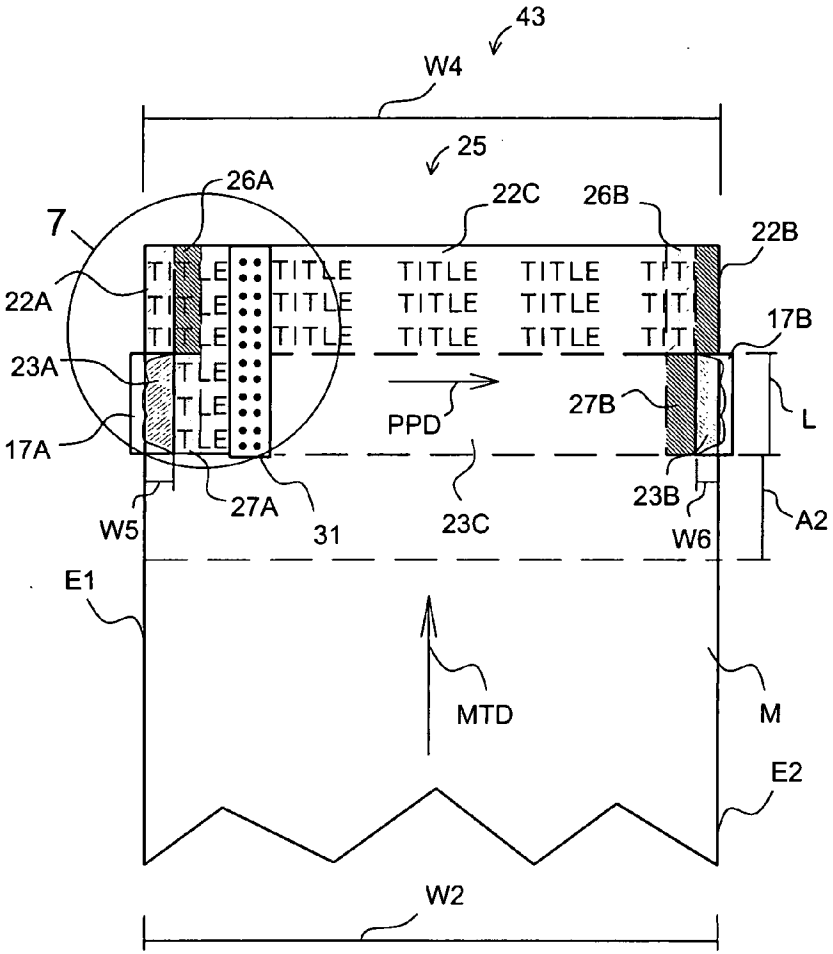
FIG. 6 is a schematic representation of a printzone and a printhead for an inkjet imaging device.
Figure 7:
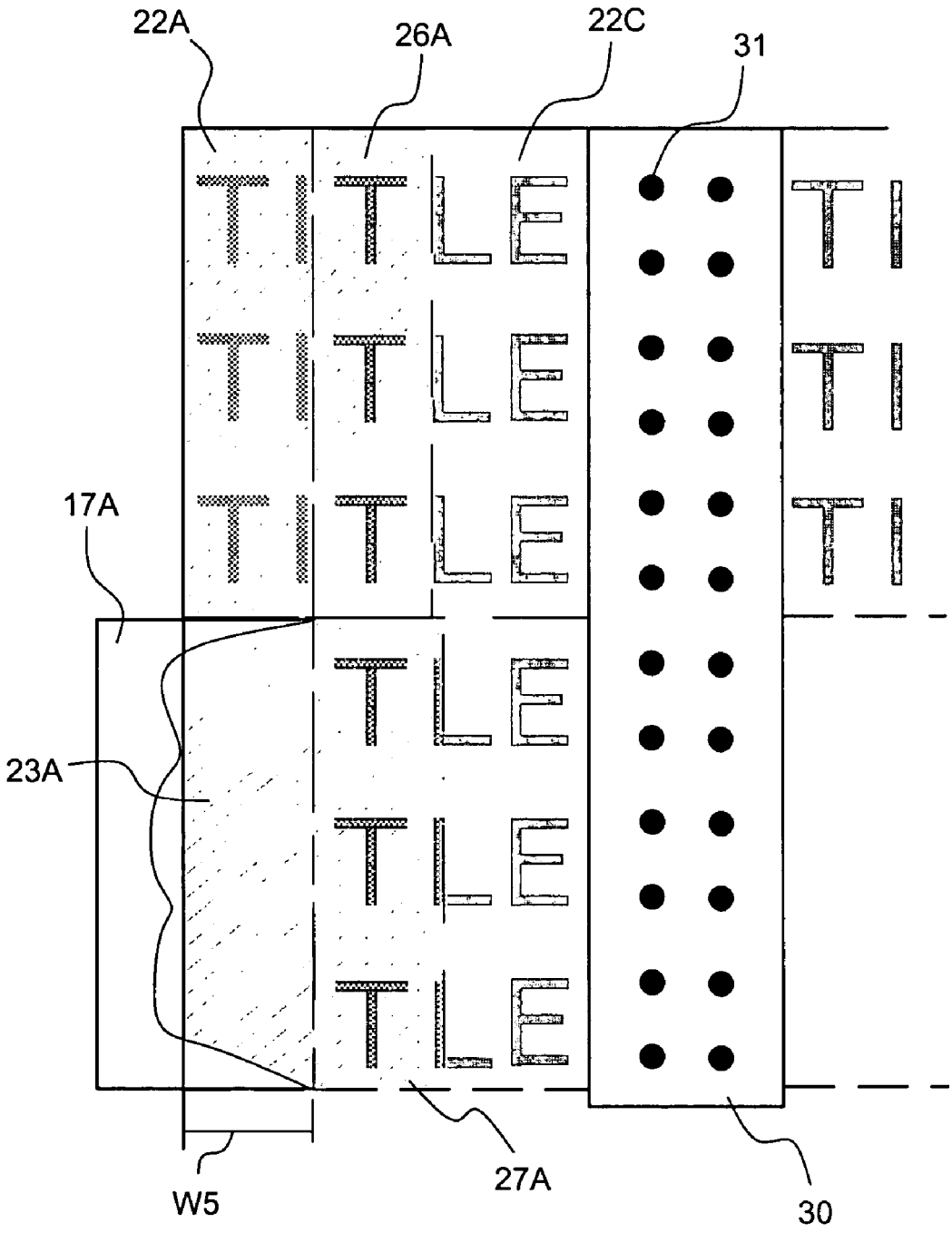
FIG. 7 is a schematic representation of a partial printzone and a printhead for an inkjet imaging device.

Referring to FIGS. 6 and 7, a solution for a concern that a print defect may result and would be set off by a distinct line between zones 23A and 23C and/or 23B and 23C may arise with application of the present invention. As shown, print disable zone 23A once again includes all pixels defined by the printmask that correspond to an area of printzone 25 that is substantially equal a length L of edge guide 17A times a width W5 of edge guide 17A that overlays print media M. Print disable zone 23B includes all pixels defined by the printmask that correspond to an area of printzone 25 that is substantially equal a length L of edge guide 17B times a width W6 of edge guide 17B that overlays print media M. In FIG. 6 transition zones 26A, 26B, 27A and 27B are shown. FIG. 7 shows in greater detail transition zones 26A and 27A.

To illustrate the advantage of the use of transition zones, a two pass printmode is described. Area 22C, having received 50% of its ink on a first pass, (prior to the pass shown in FIGS. 6 and 7), receives an additional 50% coverage resulting in a full density image. Areas 26A and 26B, having received a gradient of 50% density at their edges next to 22C to 0% at their edges next to 22A and 22B on a first pass, (prior to the pass shown in FIGS. 6 and 7), receives a gradient of ink from 100% on their edges next to 22A and 22B, to 50% on their edges next to 22C, resulting in a full density image. Areas 22A and 22B receive 100% coverage. Areas 27A and 27B receive a gradient from 0% on their edges next to 23A and 23B, to 50% on their edges next 23C. Area 23C receives 50%. This method may be employed by extrapolation to other multi-pass printmodes.

Figure 8:
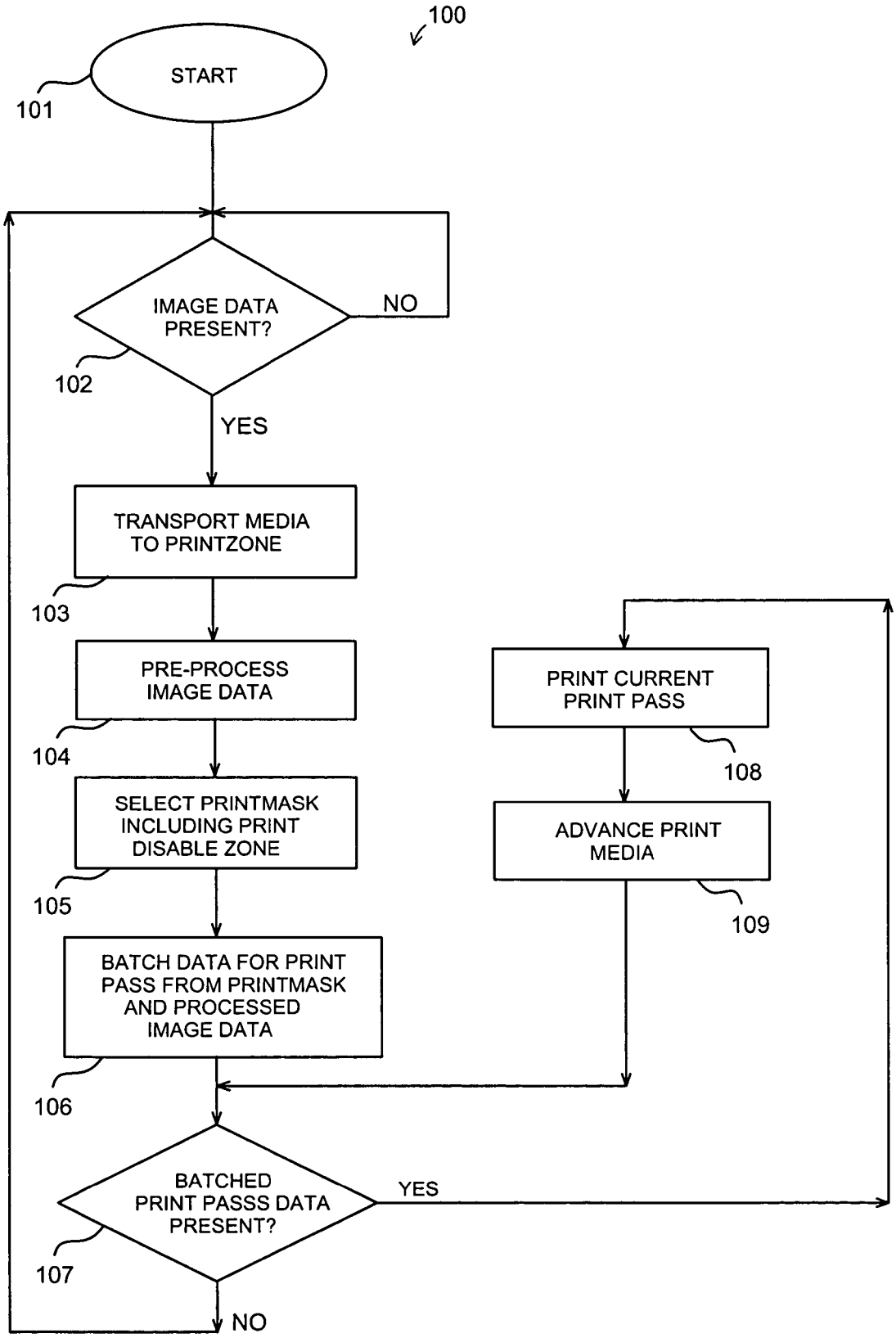
FIG. 8 is a schematic block flow diagram showing the details of one embodiment of a full bleed printmode according to one embodiment of the present invention.

Referring to FIG. 8, a schematic block flow diagram shows steps of one preferred embodiment of method 100 for narrow margin printing with an inkjet printer. At START 101, the inkjet imaging device is energized. The controller queries whether or not image data is present for processing at IMAGE DATA PRESENT? 102. In the event that image data is not present method 100 loops until such time as data is present for processing. In the event that image data is present, method 100 proceeds to TRANSPORT MEDIA TO PRINTZONE 103 where a print media is transported into a printzone defined by a height of the plurality of print nozzles and a width of the print media. At PRE-PROCESS IMAGE DATA 104, standard image processing functions such as sharpening, resizing and color conversion may be performed. Next, at SELECT PRINTMASK INCLUDING PRINT DISABLE ZONE 105, a printmask including a defined print disable zone is selected. Next, the method batches processed image data using the printmask at BATCH DATA FOR PRINT PASS FROM PRINTMASK AND PROCESSED IMAGE DATA 106. Next, the controller queries whether or not batched print pass data is present for printing BATCHED PRINT PASS DATA PRESENT? 107. In the event that there is no batched print pass data present, method 100 loops until such time as data is present for processing. In the event that batched print pass data is present for printing method 100 proceeds to PRINT CURRENT PRINT PASS 108 where ink is selectively deposited from the print nozzle to the media forming an image including a narrow margin by printing in a narrow margin mode only in those marginal areas that are not occupied by the edge guide. Following execution of the print pass, the print media is advanced at ADVANCE PRINT MEDIA 109 and the method 100 loops back to BATCHED PRINT PASS DATA PRESENT? 107.

Although the present invention has been described with reference to specific embodiments, those of skill in the art will recognize that changes may be made thereto without departing from the scope and spirit of the invention as defined by the appended claims.

What is claimed is:

1. An inkjet printer comprising:

a plurality of print nozzles;

an edge guide projecting into a print zone into which at least one of the plurality of print nozzles may be transported for deposition of a fluid onto a print media;

computer readable medium having a printmask defining a print disable zone including a pre-selected area of the print zone substantially equal to an area of the edge guide that projects into the print zone.

2. An inkjet printer according to claim 1 wherein the print disable zone further comprises an area of the print zone substantially equal to a length of the edge guide times a width of a print media.

3. An inkjet printer according to claim 1 wherein the print disable zone further comprises an area of the print zone substantially equal to a length of the edge guide times a width of a portion of the print media that lies beneath the edge guide.

4. An inkjet printer according to claim 1 further comprising the printmask defining a narrow margin print zone located adjacent to the print disable zone.

5. An inkjet printer according to claim 4 further comprising the printmask defining a graduated print zone located between a narrow margin print zone and a full image density print zone.

6. An inkjet imaging device comprising: a printer controller;

a media transport assembly connected to and controlled by the printer controller for transporting a print media along a media travel direction;

a printhead including a plurality of print nozzles, the printhead connected to and controlled by the printer controller for controllably activating the print nozzles to eject drops of ink, the printhead connected to a carriage for transporting the printhead across the print media;

a print zone defined by a height of the plurality of print nozzles and the width of the print media:

an edge guide located adjacent to a marginal edge of the print media, the edge guide located in The print zone; and a computer readable medium having a printmode including a printmask defining a print disable zone including a pre-selected area of the print zone substantially equal to an area of the edge guide that projects into the print zone.

7. A printmode according to claim 6 wherein the print disable zone further comprises an area of the print zone substantially equal to an aggregate length of the edge guide times a width of a print media.

8. A printmode according to claim 6 wherein the print disable zone further comprises an area of the print zone substantially equal to a length of the edge guide times a width of a portion of the print media that lies beneath the edge guide.

9. A printmode according to claim 6 further comprising the printmask defining a narrow margin print zone located adjacent to the print disable zone.

10. A printmode according to claim 9 further comprising the printmask defining a graduated print zone located between a narrow margin print zone and a full image density print zone.

11. A method for narrow margin printing with an inkjet printer including the steps of:

selecting a printmode including a printmask defining a print disable zone including a pre-selected area of the print zone substantially equal to length of the edge guide times a width of a portion of the print media that lies beneath the edge guide;

transporting a print media into a print zone defined by a height of the plurality of print nozzles and a width of the print media; and selectively depositing ink from the print nozzle to the media forming an image including a narrow margin by printing in a narrow margin mode only in those marginal areas that are not occupied by the edge guide.

12. A method for narrow margin printing according to claim 11 wherein the step of defining a print disable zone further includes defining an area of the print zone substantially equal to a length of the edge guide times a width of a print media as the print disable zone.

13. A method for narrow margin printing according to claim 11 further including the step defining a narrow margin print zone located adjacent to the print disable zone.

14. A method for narrow margin printing according to claim 11 further including the step defining a graduated print zone located between a narrow margin print zone and a full image density print zone.

* * * * *